US011133590B2

(12) United States Patent
Yanagi

(10) Patent No.: US 11,133,590 B2
(45) Date of Patent: Sep. 28, 2021

(54) ANTENNA AND ANTENNA MODULE

(71) Applicant: FUJITSU COMPONENT LIMITED, Tokyo (JP)

(72) Inventor: Masahiro Yanagi, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 77 days.

(21) Appl. No.: 16/373,894

(22) Filed: Apr. 3, 2019

(65) Prior Publication Data

US 2019/0312354 A1 Oct. 10, 2019

(30) Foreign Application Priority Data

Apr. 10, 2018 (JP) ..... JP2018-075215

(51) Int. Cl.

| | |
|---|---|
| ***H01Q 9/04*** | (2006.01) |
| ***H01Q 1/48*** | (2006.01) |
| ***H01Q 1/22*** | (2006.01) |
| ***H01Q 19/10*** | (2006.01) |

(52) U.S. Cl.

CPC ..... *H01Q 9/0407* (2013.01); *H01Q 1/48* (2013.01); *H01Q 19/104* (2013.01); *H01Q 1/2283* (2013.01)

(58) Field of Classification Search

CPC .... H01Q 9/0407; H01Q 19/104; H01Q 15/14; H01Q 19/10; H01Q 1/2283

See application file for complete search history.

(56) References Cited

U.S. PATENT DOCUMENTS

| | | | | |
|---|---|---|---|---|
| 2013/0187830 | A1* | 7/2013 | Warnick | H01Q 9/0428 343/893 |
| 2016/0006131 | A1* | 1/2016 | Matsumura | H01L 23/293 343/834 |
| 2018/0076530 | A1* | 3/2018 | Kawahata | H01Q 1/48 |

FOREIGN PATENT DOCUMENTS

| | | | | |
|---|---|---|---|---|
| CA | 2737225 | | 3/2010 | |
| JP | H07-050505 | | 2/1995 | |
| JP | 2004-266618 | | 9/2004 | |
| JP | 2004659631 | * | 9/2004 | H01Q 19/10 |
| WO | WO-2007144104 | A1 * | 12/2007 | H01Q 1/3275 |

* cited by examiner

*Primary Examiner* — Ricardo I Magallanes
(74) *Attorney, Agent, or Firm* — IPUSA, PLLC

(57) ABSTRACT

An antenna includes a dielectric substrate, an antenna element formed on a first surface of the dielectric substrate, a ground element formed on a second surface of the dielectric substrate, and a metal conductor plate disposed over, and at a spaced distance from, the first surface of the dielectric substrate, the metal conductor plate being larger than the ground element.

1 Claim, 11 Drawing Sheets

ANTENNA AND ANTENNA MODULE

BACKGROUND OF THE INVENTION

1. Field of the Invention

The disclosures herein relate to an antenna and an antenna module.

2. Description of the Related Art

Antennas for transmitting and receiving radio waves are used in wireless communication. There are needs for an antenna capable of transmitting radio waves over as large a distance as possible and an antenna capable of receiving weak radio waves.

An antenna is required to have not only an increased gain but also an improved directivity in order to transmit radio waves over as large a distance as possible and to receive weak radio waves. An antenna having a complex shape and a large size is not easy to handle, and is not suitable for provision in a portable device.

There is a certain type of antenna module in which an antenna is connected to an electronic circuit for generating radio waves to be transmitted from the antenna and connected to a signal processing circuit for processing radio wave signals received by the antenna. Size reduction is also required for such an antenna module.

RELATED-ART DOCUMENTS

Patent Document

[Patent Document 1] Japanese Patent Application Publication No. 2004-266618

[Patent Document 2] Japanese Patent Application Publication No. H7-50505

SUMMARY OF THE INVENTION

It is a general object of the present invention to provide an antenna that substantially obviates one or more problems caused by the limitations and disadvantages of the related art.

According to an embodiment, an antenna includes a dielectric substrate, an antenna element formed on a first surface of the dielectric substrate, a ground element formed on a second surface of the dielectric substrate, and a metal conductor plate disposed over, and at a spaced distance from, the first surface of the dielectric substrate, the metal conductor plate being larger than the ground element.

According to at least one embodiment, a small antenna having such a shape that is easy to handle and having a satisfactory directivity is provided.

BRIEF DESCRIPTION OF THE DRAWINGS

Other objects and further features of the present invention will be apparent from the following detailed description when read in conjunction with the accompanying drawings, in which.

DESCRIPTION OF THE PREFERRED EMBODIMENTS

In the following, embodiments for implementing the invention will be described. The same members or the like are referred to by the same numerals, and a description thereof will be omitted.

<Structure of Antenna>

Figure 1A:
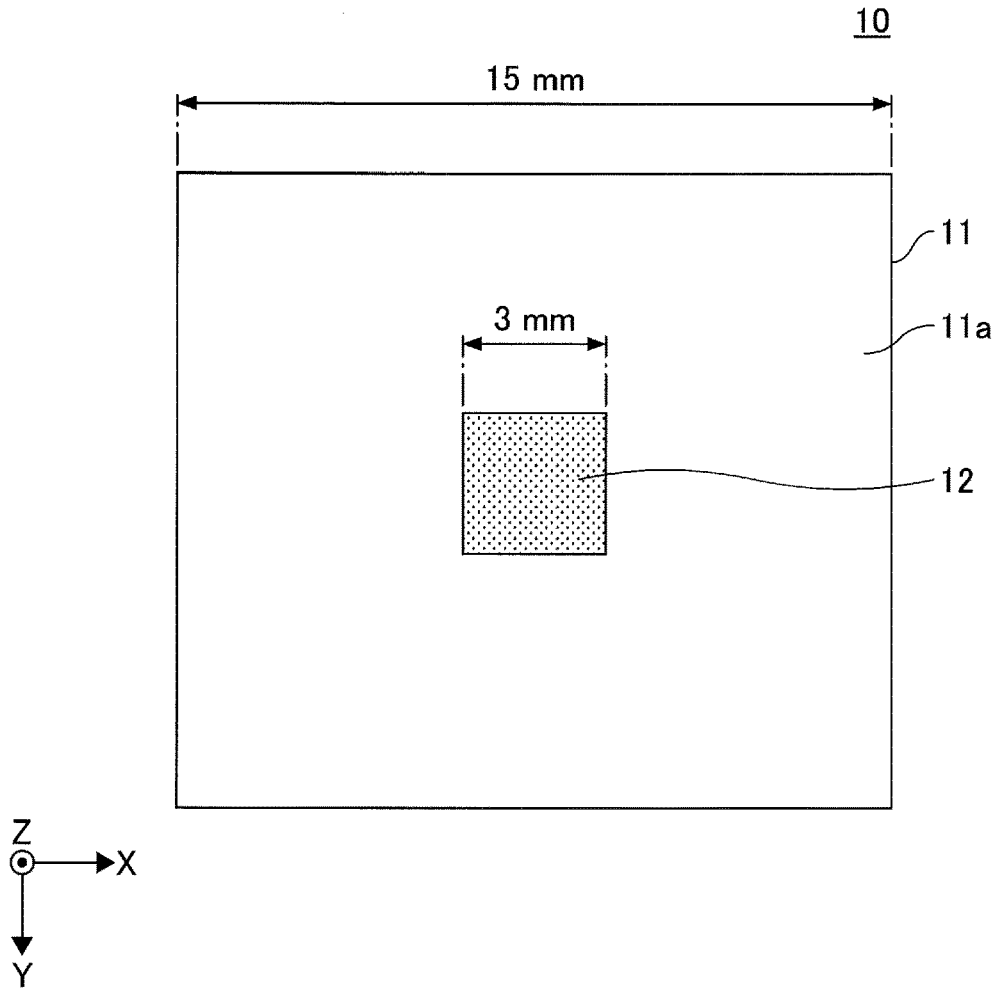
FIGS. 1A and 1B are drawings illustrating the structure of a patch antenna.
Figure 1B:
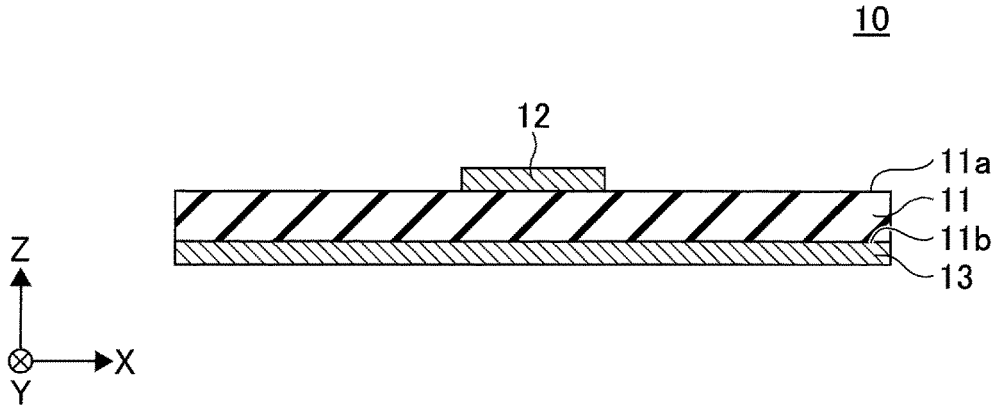
Figure 2:
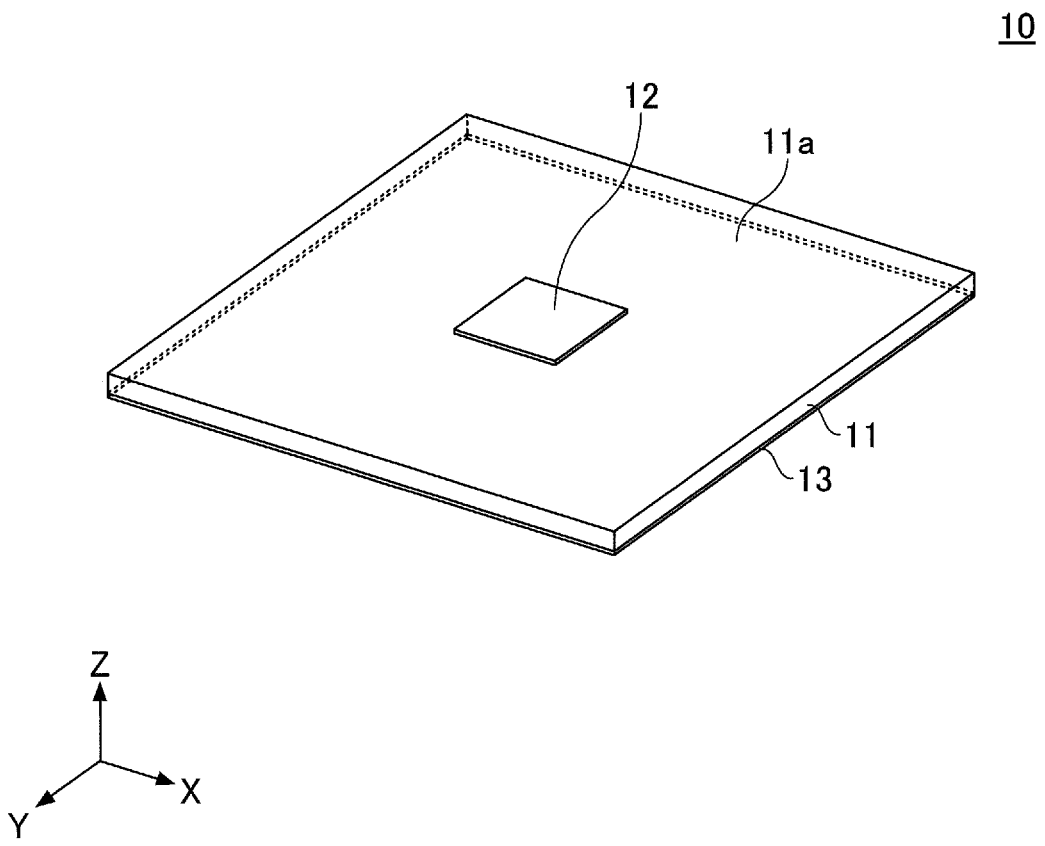
FIG. 2 is an axonometric view of the patch antenna.

In the following, a patch antenna 10 will be described. FIG. 1A is a top view of the patch antenna 10. FIG. 1B is a cross-sectional view of the patch antenna 10. FIG. 2 is an axonometric view of the patch antenna 10.

The patch antenna 10 includes an insulating dielectric substrate 11, an antenna element 12 disposed on a surface 11*a* of the dielectric substrate 11, and a ground element 13 disposed on a surface 11*b* of the dielectric substrate 11. The antenna element 12 and the ground element 13 are metal films that are electrically conductive. The ground element 13 is coupled to a ground potential. The antenna element 12, which receives a feed power, serves as a radiation plane for radiating radio waves.

The dielectric substrate 11 is a square plate with a side of 15 mm and a thickness of 0.5 mm, which is made of a glass epoxy resin or the like having a relative permittivity of approximately 4.7. The antenna element 12 is a square shape with a side of 3 mm, and is formed at the center of the surface 11*a*. The ground element 13 is a square shape with a side of 15 mm disposed over the entirety of the surface lib. The antenna element 12 and the ground element 13 may be made of copper foils with a thickness of 40 micrometers, for example.

Figure 3:
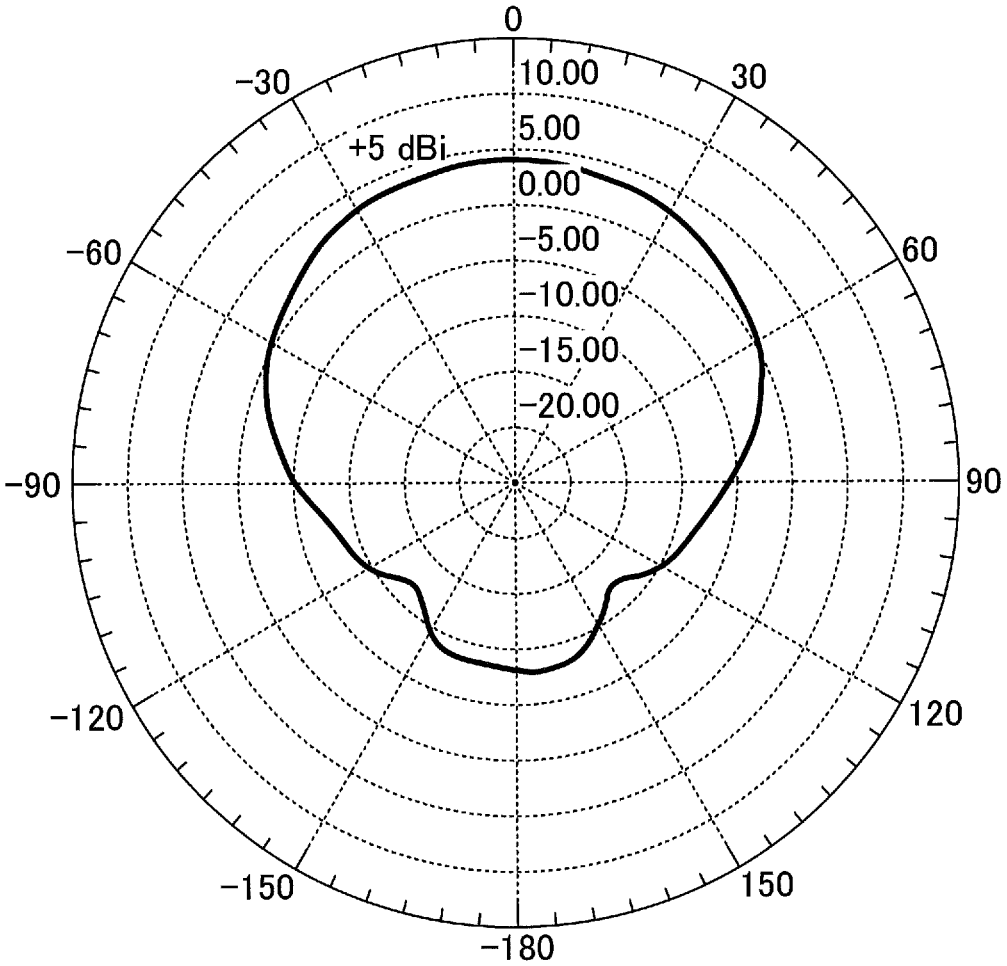
FIG. 3 is a drawing illustrating the characteristics of the patch antenna.
Figure 3:
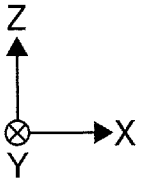

The patch antenna 10 is designed for a frequency of 24 GHz. With 2 being the wavelength of a 24-GHz radio wave, the length of a side of the antenna element 12, which may be set to $\lambda/2$, is set to 3 mm with consideration for the effect of wavelength reduction resulting from the relative permittivity of the dielectric substrate 11. Simulation performed with respect to the patch antenna 10 revealed the presence of directivity as illustrated in FIG. 3, in which radio waves are stronger in the positive Z direction that is on the same side as where the antenna element 12 is disposed. The gain of radio waves in the positive Z direction is approximately +5 dBi.

<Antenna>

Figure 4:
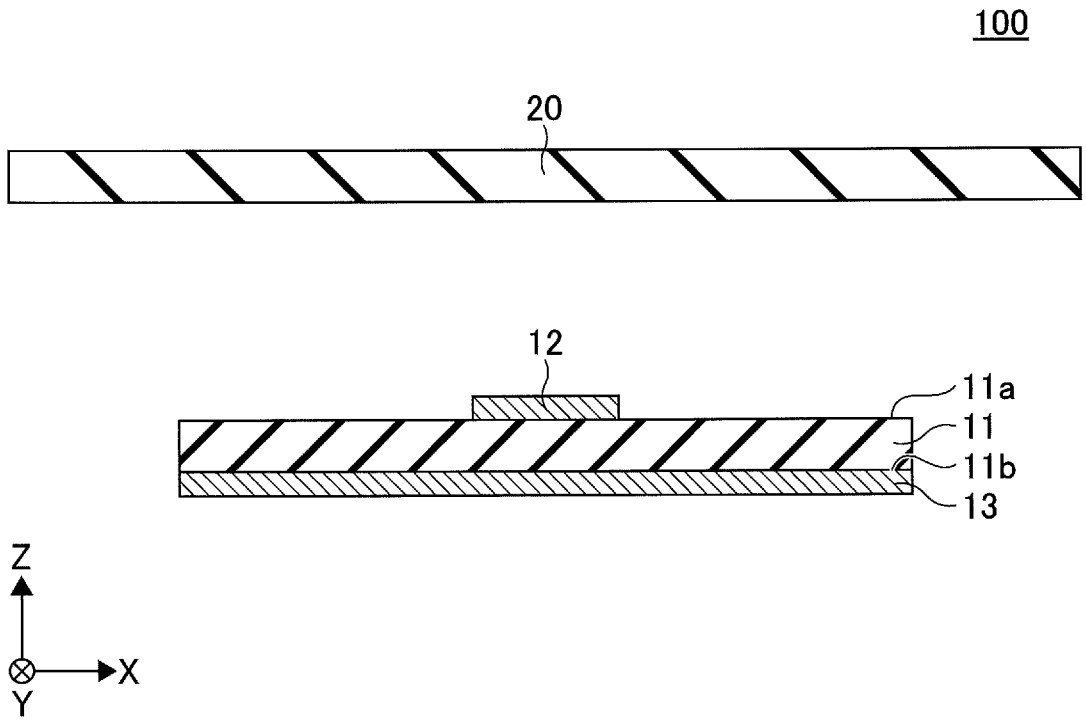
FIG. 4 is a drawing illustrating the structure of an antenna according to an embodiment.
Figure 5:
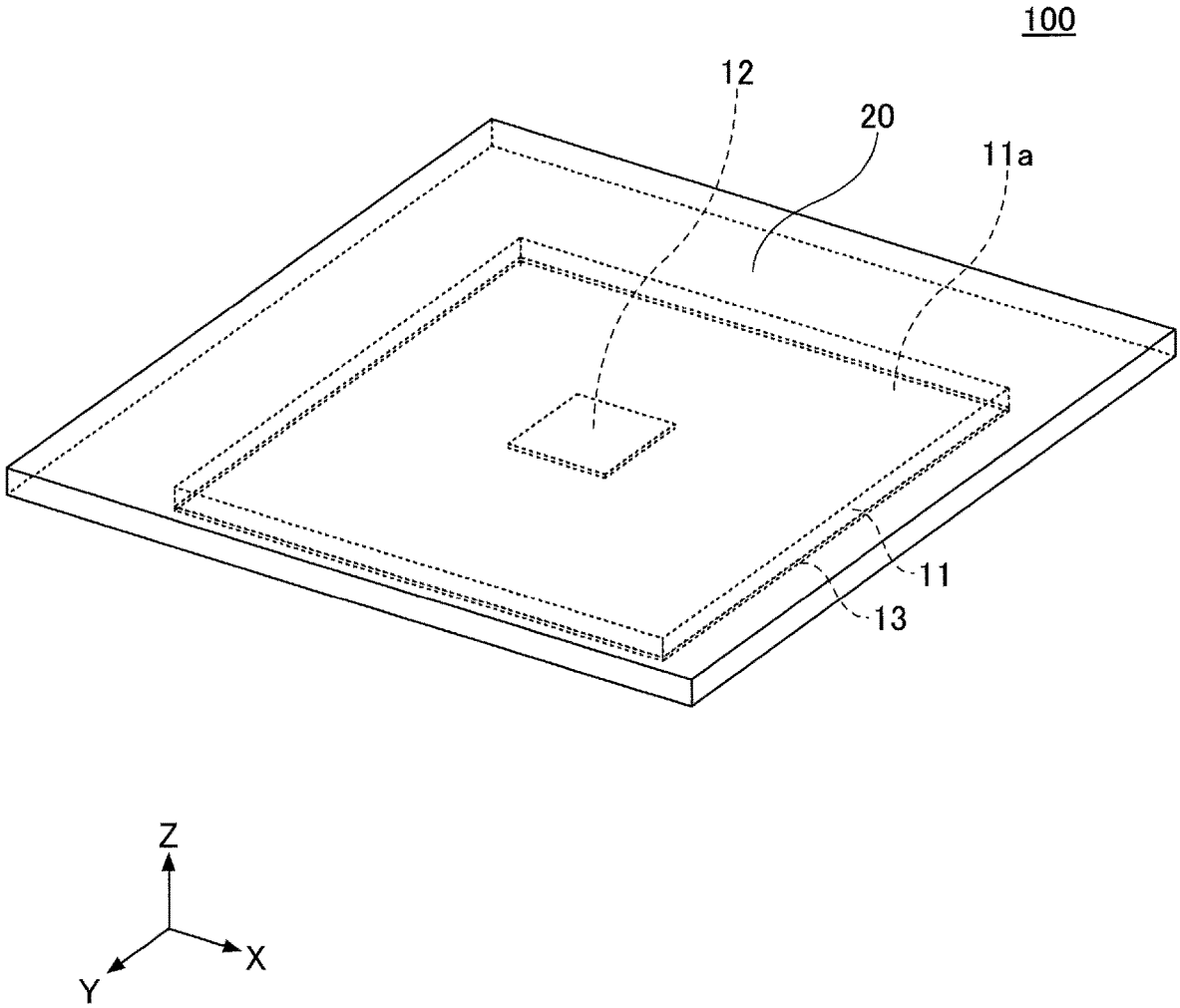
FIG. 5 is an axonometric view of the antenna according to the embodiment.

In the following, an antenna 100 according to the present embodiment will be described with reference to FIG. 4 and FIG. 5. FIG. 4 is a cross-sectional view of the antenna 100. FIG. 5 is an axonometric view of the antenna 100. The antenna 100 is configured such that a metal conductor plate 20 is situated on the positive Z side of the patch antenna 10.

Figure 6:
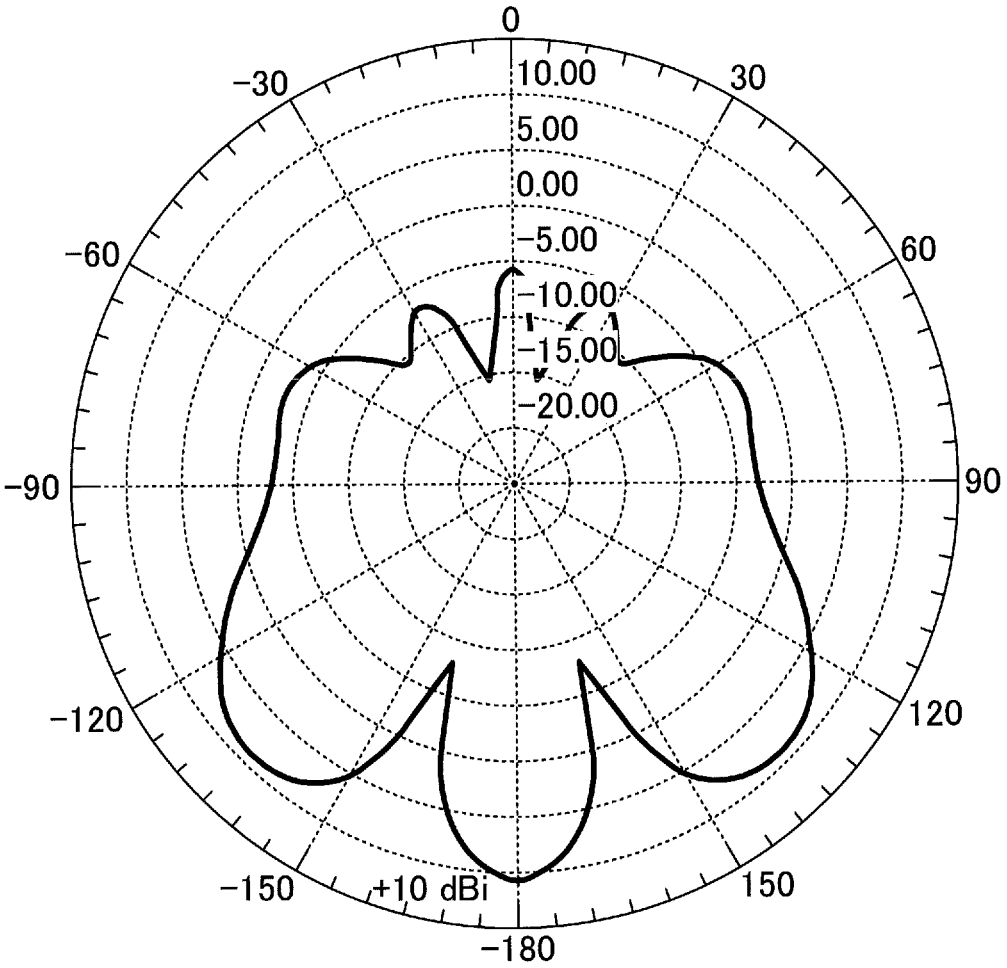
FIG. 6 is a drawing illustrating the characteristics of the antenna according to the embodiment.
Figure 6:
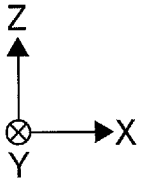

The metal conductor plate 20 is a plate made of a conductive metal material such as copper (Cu), aluminum (Al), or stainless. Simulation performed with respect to the antenna 100 revealed the presence of directivity as illustrated in FIG. 6, in which radio waves are stronger in the negative Z direction opposite from where the antenna element 12 is disposed. The gain of radio waves in the negative Z direction is approximately +10 dBi.

Namely, the antenna 100 has a directivity pointing to the opposite direction from where the antenna element 12 is disposed, and also has a stronger gain. The metal conductor plate 20 may have holes or slits, except for the area situated directly above the antenna element 12.

<Simulation>

Figure 7:
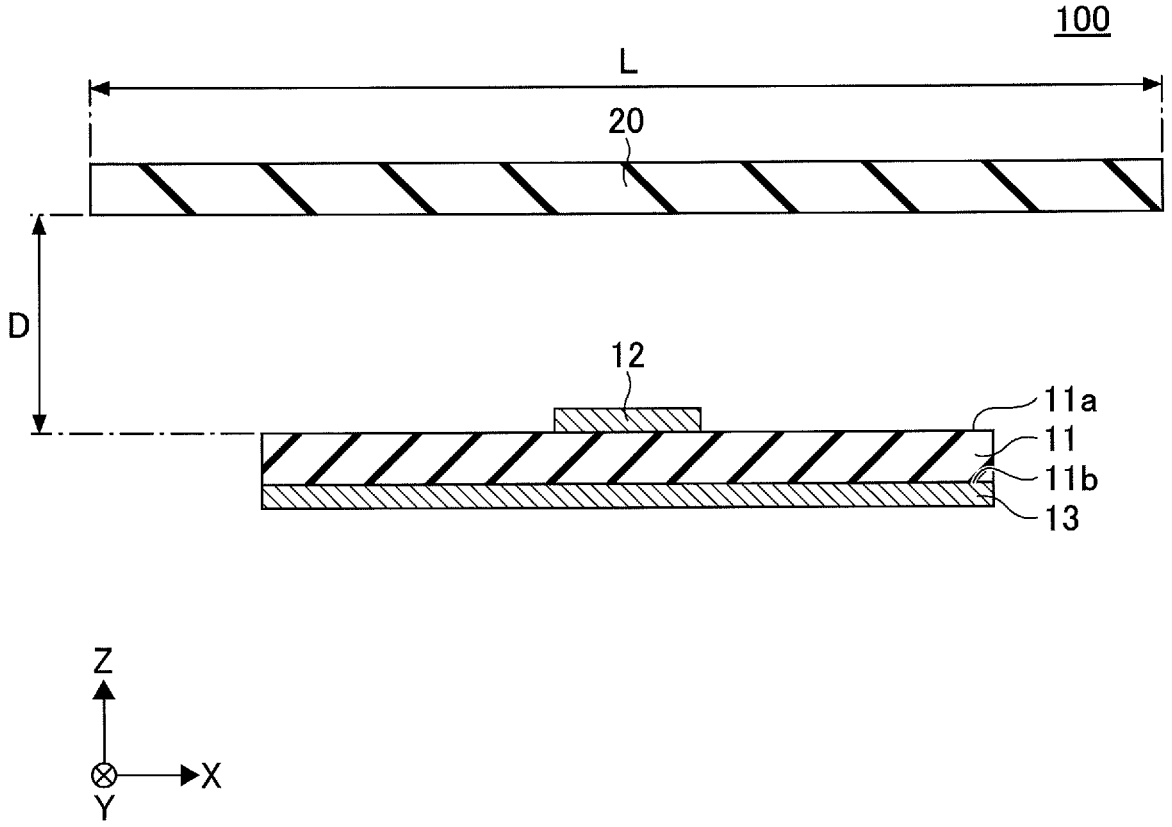
FIG. 7 is a drawing illustrating a simulation model of the antenna according to the embodiment.

Simulation was conducted with respect to the antenna 100 illustrated in FIG. 7 under the conditions of varying size of the metal conductor plate 20 and under the conditions of varying distance between the patch antenna 10 and the metal conductor plate 20.

The simulation conducted under the conditions of varying size of the metal conductor plate 20 will be described first. The simulations were conducted with respect to the square metal conductor plates 20 having differing side lengths L as follows: 15 mm, 20 mm, and 25. A distance D between the patch antenna 10 and the metal conductor plate 20 in the Z direction is 0.5 mm.

Figure 8:
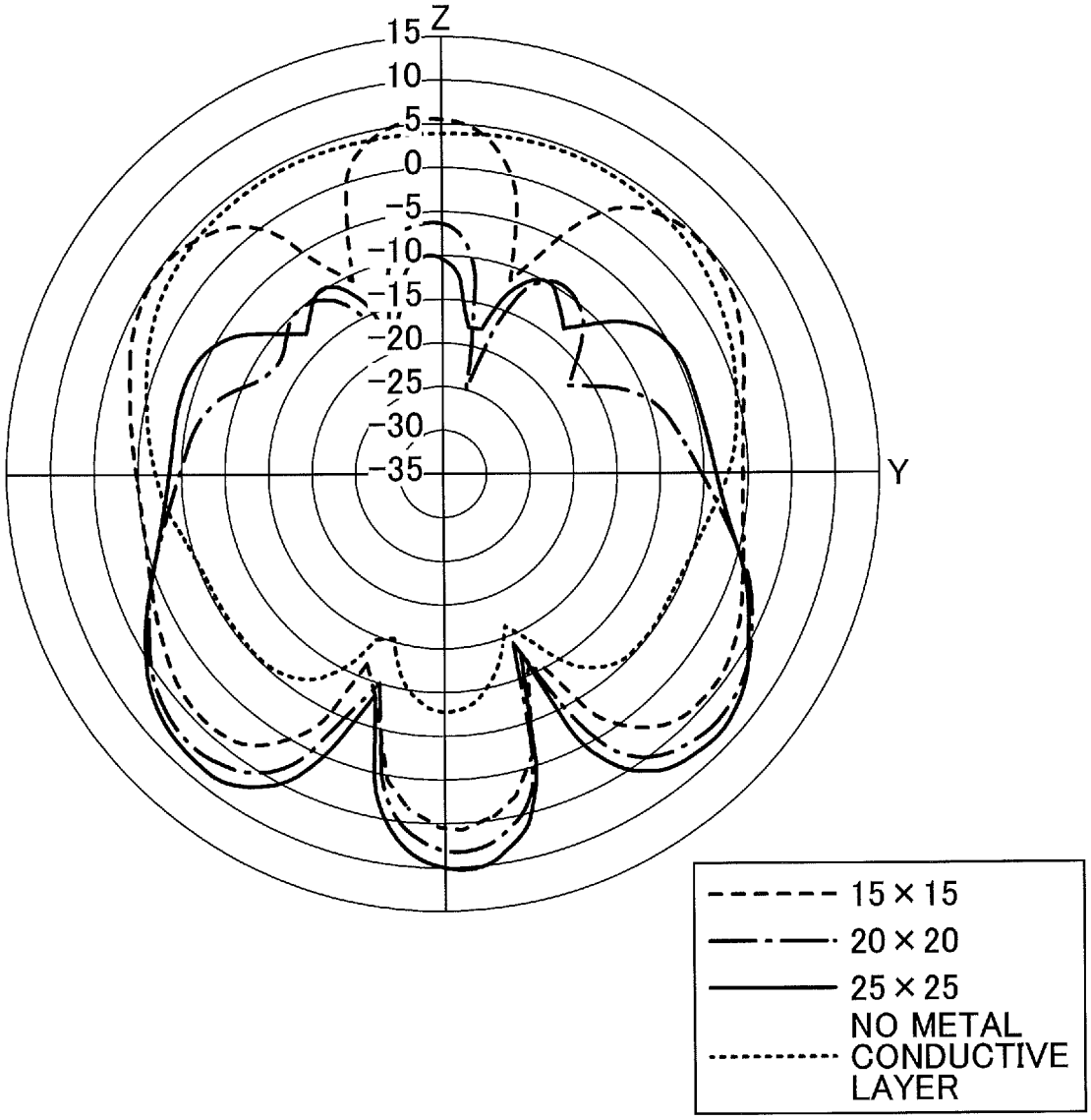
FIG. 8 is a drawing illustrating characteristics obtained by antenna simulation.

The results of the simulations are shown in FIG. 8. In the case of the length L of the side of the metal conductor plate 20 being 15 mm, the gain in the positive Z direction is approximately +5 dBi, which is about the same as in the case of no metal conductor plate 20 being provided. The gain in the negative Z direction is also +5 dBi.

As the size of the metal conductor plate 20 increases, however, the gain in the positive Z direction decreases, and the gain in the negative Z direction increases. In the case of the length L of the side of the metal conductor plate 20 being 25 mm, the gain in the positive Z direction is approximately −10 dBi, and the gain in the negative Z direction is approximately +10 dBi.

In the case of the length L of the side of the metal conductor plate 20 being 15 mm, the metal conductor plate 20 is approximately the same size as the dielectric substrate 11 and the ground element 13. In this case, the gain in the positive Z direction is approximately the same as in the case in which the no metal conductor plate 20 is provided, and is also approximately the same as the gain in the negative Z direction.

In the present embodiment, the metal conductor plate 20 is made larger than the dielectric substrate 11 and the ground element 13, which increases directivity in the negative Z direction. The above description has been given with respect to the case in which the metal conductor plate 20 is a square. The same applies in the case of a rectangle. When the metal conductor plate 20 is a rectangle of 15 mm by 20 mm, the advantage of increasing directivity in the negative Z direction may similarly be provided.

The simulations conducted under the conditions of differing distance between the patch antenna 10 and the metal conductor plate 20 will be described in the following. The metal conductor plate 20 was a square with a side length L of 25 mm. Simulations were conducted with respect to differing distances D in the Z direction between the patch antenna 10 and the metal conductor plate 20 as follows: 0.2 mm, 0.3 mm, 0.4 mm, 0.5 mm, 0.7 mm, 1.0 mm, 1.5 mm, 2.0 mm, 2.5 mm, 3.0 mm, 4.0 mm, and 5.0 mm. The results of the simulations are shown in FIG. 9.

Figure 9:
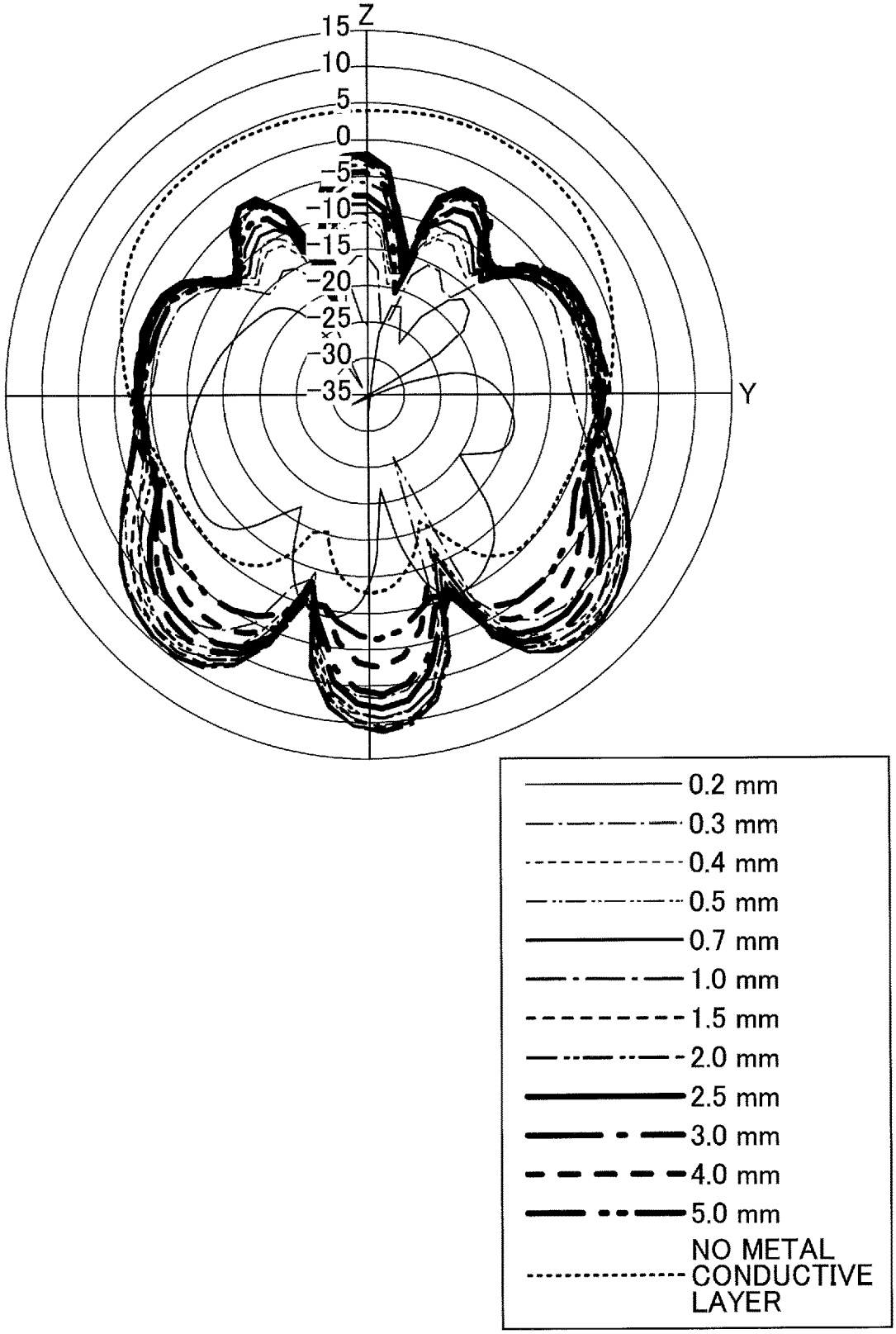
FIG. 9 is a drawing illustrating characteristics obtained by antenna simulation.

As illustrated in FIG. 9, the gain in the negative Z direction decreases when the distance between the patch antenna 10 and the metal conductor plate 20 is below 0.3 mm or above 3.0 mm. Accordingly, the distance D between the patch antenna 10 and the metal conductor plate 20 is preferably greater than or equal to 0.3 mm and less than or equal to 3.0 mm. The wavelength λ, for a frequency of 24 GHz is 12 mm, which means that the distance D between the patch antenna 10 and the metal conductor plate 20 is preferably greater than or equal to λ/40 and less than or equal to λ/4.

The antenna 100 of the present embodiment has the patch antenna 10 and the metal conductor plate 20 such that the metal conductor plate 20 is a plate shape. With this arrangement, the antenna 100 is easy to install, and the size of the apparatus for which the antenna 100 is installed does not have to be large. Improving the directivity of an antenna may also be achieved by use of a structure in which the metal conductor plate has a curved surface, for example. With such a structure, however, the size of the antenna increases due to its curved surface. Further, since the metal conductor plate needs to be shaped into a curved form, the number of process steps increases, which results in a cost increase. The metal conductor plate 20 of the present embodiment is flat, which allows the apparatus to be smaller scale than in the case of a curved-surface metal conductor plate. Further, there is no increase in the number of process steps, which results in low production cost.

<Antenna Module 1>

In the following, an antenna module 201 of the present embodiment will be described by referring to FIG. 10. The antenna module 201 has an antenna formed with a circuit substrate that includes multilayered interconnections. A conductor layer serving as the ground element 13 is formed inside a circuit substrate 210. Dielectric layers 210*a* and 210*b* are formed on the respective surfaces of the ground element 13.

The antenna element 12 is disposed on a surface of the dielectric layer 210*a*. Electronic components 211, 212, and 213 are mounted on a surface of the dielectric layer 210*b*. The antenna element 12 and the electronic component 212 for supplying a radio frequency signal to the antenna element 12 are coupled to each other through a penetrating electrode 214. The electronic component 212 feeds power to the antenna element 12 through the penetrating electrode 214. The flat metal conductor plate 20 is disposed over the surface of the dielectric layer 210*a* on which the antenna element 12 is formed.

In the antenna module 201, the ground element 13 situated between the antenna element 12 and the electronic components 211, 212, and 213 is coupled to a ground potential, so that noise generated by the electronic components 211, 212, and 213 such as electromagnetic waves is blocked by the ground element 13 so as not to affect the antenna element 12.

Figure 10:
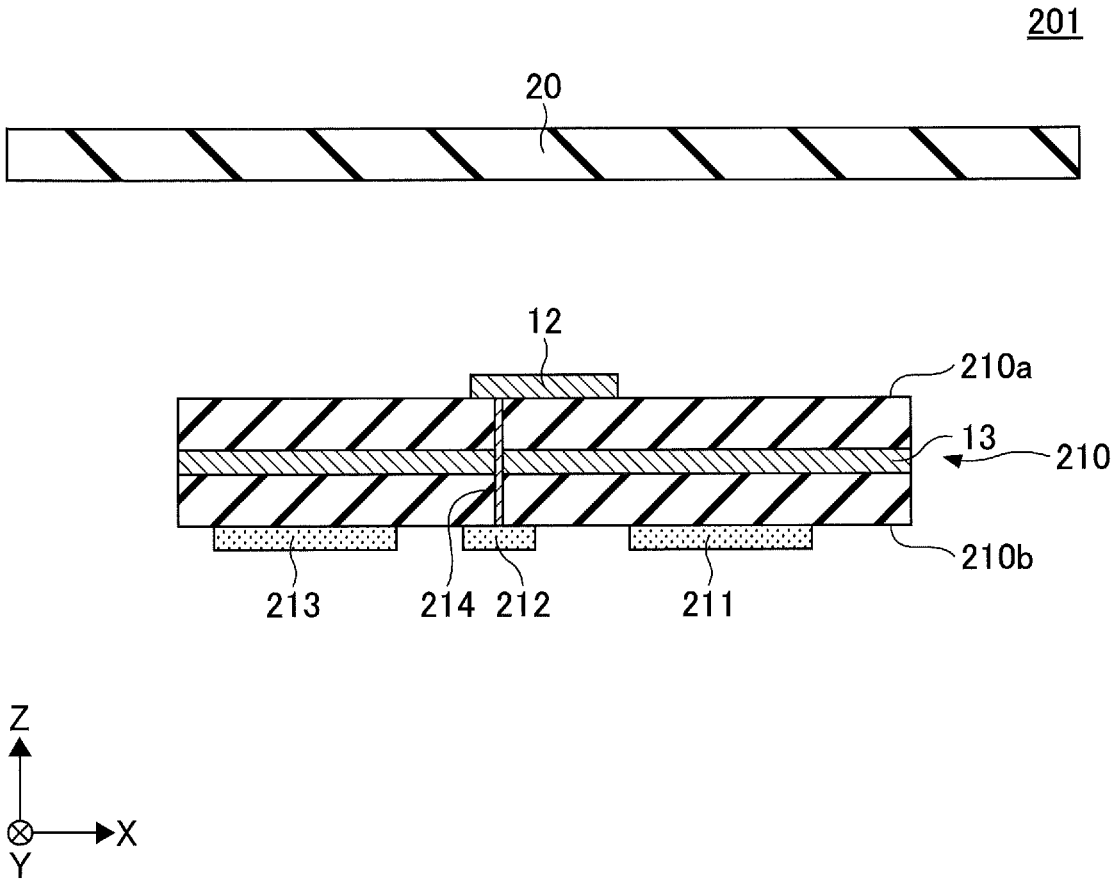
FIG. 10 is a drawing illustrating the structure of an antenna module according to an embodiment.

In the antenna module 201 illustrated in FIG. 10, the dielectric layers 210*a* and 210*b*, the antenna element 12, the ground element 13, and the metal conductor plate 20 constitute an antenna. This configuration of the antenna module 201 allows the electronic component 211 and part of the antenna of the present embodiment to be incorporated into a single circuit substrate 210, which serves to provide a small-scale antenna module 201. Accordingly, the antenna module 201 having a high directivity is reduced in size.

<Antenna Module 2>

Figure 11:
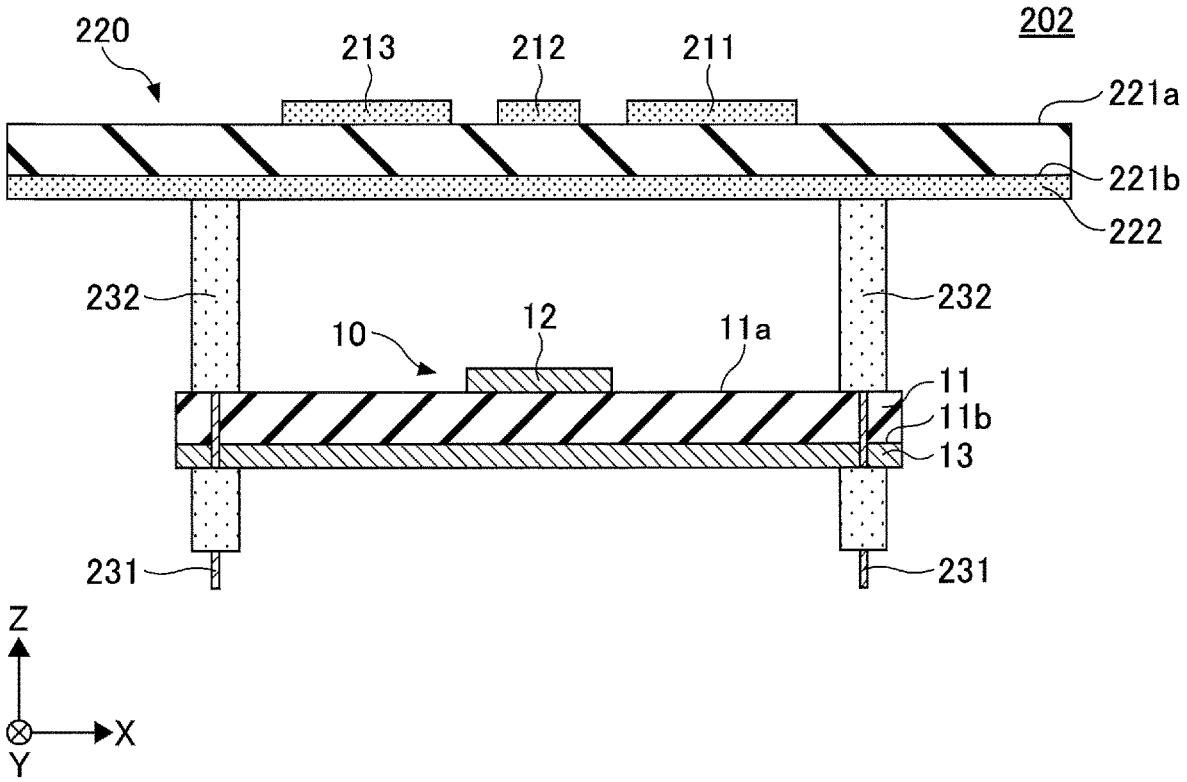
FIG. 11 is a drawing illustrating the structure of the antenna module according to the embodiment.

In the following, an antenna module 202 of the present embodiment will be described by referring to FIG. 11. The antenna module 202 includes the patch antenna 10 and a circuit substrate 220. The electronic components 211, 212, and 213 are mounted on a surface 221*a* of the circuit substrate 220. A ground pattern 222 is formed on the entirety of a surface 221*b* of the circuit substrate 220. The ground pattern 222 is made of a metal material such as Cu. The ground pattern 222 of the antenna module 202 serves as the metal conductor plate of the antenna.

The electronic component 212 mounted on the surface 221*a* to supply a signal to the antenna element 12 is coupled to the antenna element 12 through interconnections which are not shown. The ground element 13 formed on the surface 11*b* of the dielectric substrate 11 and the ground pattern 222 are coupled to each other through interconnections which are not shown.

In the antenna module 202, the surface 11*a* of the dielectric substrate 11 and the surface 221*b* of the circuit substrate 220 face each other, and the dielectric substrate 11 and the circuit substrate 220 are connected to each other through connect pins 231 situated inside spacers 232, with the spacers 232 placed between the dielectric substrate 11 and the circuit substrate 220. With this arrangement, the distance between the dielectric substrate 11 and the circuit substrate 220 is kept to a fixed length by the spacers 232.

In the antenna module 202, the ground pattern 222 and the antenna element 12 face each other, and the ground pattern 222 coupled to the ground potential is situated between the antenna element 12 and the electronic components 211, 212, and 213. Noise generated by the electronic components 211, 212, and 213 such as electromagnetic waves is blocked by the ground pattern 222 so as not to affect the antenna element 12.

Further, although a description has been given with respect to one or more embodiments of the present invention, the contents of such a description do not limit the scope of the invention.

The present application is based on and claims priority to Japanese patent application No. 2018-075215 filed on Apr. 10, 2018, with the Japanese Patent Office, the entire contents of which are hereby incorporated by reference.

What is claimed is:

1. An antenna module, comprising:

a dielectric substrate;

an antenna element formed on a first surface of the dielectric substrate;

a ground element formed on a second surface of the dielectric substrate;

a circuit substrate having an electronic component mounted on a first surface thereof; and a ground pattern formed on a second surface of the circuit substrate, the ground pattern being larger than the ground element, wherein the first surface of the dielectric substrate faces the second surface of the circuit substrate, and wherein the electronic component is configured to supply a signal to the antenna element through interconnections provided within spacers placed between the dielectric substrate and the circuit substrate.

* * * * *